US006010090A

United States Patent [19]

Bushmaker et al.

[11] Patent Number: 6,010,090

[45] Date of Patent: Jan. 4, 2000

[54] METHOD OF PERFORATING A WEB

[75] Inventors: John Bushmaker, Green Bay; Richard J. Charles, Luxemburg; Lawrence D. Mikulsky, Green Bay, all of Wis.

[73] Assignee: Paper Converting Machine Co., Green Bay, Wis.

[21] Appl. No.: 09/209,793

[22] Filed: Dec. 11, 1998

[51] Int. Cl.[7] ..... B65H 35/08

[52] U.S. Cl. ..... 242/526.1; 242/160.4; 162/114; 162/118

[58] Field of Search ..... 242/160.1, 160.4, 242/526.1; 162/114, 118, 120, 194, 286

[56] References Cited

U.S. PATENT DOCUMENTS

| | | | |
|---|---|---|---|
| Re. 26,418 | 7/1968 | Bradley . | |
| Re. 28,353 | 3/1975 | Nystrand . | |
| Re. 30,598 | 5/1981 | Spencer . | |
| 2,053,786 | 9/1936 | Straubel | 242/526.1 X |
| 2,870,840 | 1/1959 | Kwitek . | |
| 3,264,921 | 8/1966 | Nystrand . | |
| 4,723,724 | 2/1988 | Bradley . | |
| 4,828,195 | 5/1989 | Hertel . | |
| 5,104,055 | 4/1992 | Buxton . | |
| 5,370,335 | 12/1994 | Vigneau . | |
| 5,458,033 | 10/1995 | Wierschke . | |
| 5,505,405 | 4/1996 | Vigneau . | |
| 5,557,997 | 9/1996 | Wunderlich . | |
| 5,725,176 | 3/1998 | Vigneau . | |
| 5,839,688 | 11/1998 | Hertel . | |

*Primary Examiner*—John Q. Nguyen

[57] ABSTRACT

An elongated web of paper is perforated along a plurality of transverse lines to provide bands of web areas having relatively high tensile strength which extend generally longitudinally along the web. The lines of perforation can be formed by staggered perforation lines which contain groups of perforations which are separated by unperforated areas or by staggered perforation lines which include groups of perforations having relatively low tensile strength which are separated by groups of perforations having relatively high tensile strength.

3 Claims, 8 Drawing Sheets

METHOD OF PERFORATING A WEB

BACKGROUND OF THE INVENTION

This invention relates to a method of perforating a web, and, more particularly, to a method of perforating a paper web which is used to form rolls of bathroom tissue or paper towels.

Rewinders are used to convert large parent rolls of paper into retail sized rolls of bathroom tissue and paper towels. Two types of rewinders are commonly used—center rewinders and surface rewinders. Center rewinders are described, for example, in U.S. Reissue Pat. No. 28,353 and wind the web on a core which is rotated by a mandrel to form a wound log. Surface rewinders are described, for example, in U.S. Pat. Nos. 4,723,724 and 5,104,055 and wind the web on a core which is rotated by a three roll cradle to form a wound log.

Before the web is wound into a log, the web is perforated along transverse lines which define the sheet length of the rolls of bathroom tissue or paper towels. After the log is wound, the log is cut into individual rolls by a log saw.

The traditional style perforator which is described, for example, in U.S. Pat. Nos. 2,870,840, Re. 26,418, and 3,264,921, consists of a rotating perforator roll and a stationary anvil bar. The perforator roll includes multiple rows of blades which extend parallel to the axis of the roll and which are spaced at a fixed interval around the circumference of the roll. The blades are notched to provide a specific perforation pattern depending upon the web. The stationary anvil bar is a large casting which holds a series of carbide anvils in a helical pattern arrangement. Each anvil can be adjusted radially to set the desired interference between the perforator blades and the anvils.

The perforation pattern is applied to the web as the web passes through the perforator by pinching the web between the perforator blades and the anvil blades. The entire width of the web is perforated in straight lines across the web at fixed intervals which define the perforation length or the sheet length of the rolls which will be formed by winding the web. The perforated web passes from the perforator to a rewinder to be wound into logs using either surface or center winding technology. Once the web is perforated, the cutting of the logs using the traditional style perforation pattern does not require precise log cutting because the perforation pattern is consistent across the web.

The problem with the present art is that the speed of the rewinder is often limited by web blowouts, where the web tension exceeds the tensile strength of the perforations. This can result in the web breaking along a perforation during winding. As rewinder speed is increased, tension can increase due to increased rewinder dynamics such as mandrel vibration.

In order to achieve a desired product diameter and firmness, the web tension is increased and may approach the tensile strength of the perforations. If the web tension meets or exceeds the tensile strength of the perforations, the web will tear on the perforations.

For some products, the tensile strength of the web is minimized in order to achieve a unique web characteristic. However, reduced web tensile strength will reduce the tensile strength of the perforated web.

SUMMARY OF THE INVENTION

The invention provides bands of relatively high tensile strength which run in a zig-zag pattern along the longitudinal direction of the web. These bands can be provided in two ways:

1. The web is perforated along staggered lines which include lengths of perforations which are separated by unperforated areas. The perforations on each line are transversely offset or staggered relative to the perforations on the adjacent lines.

2. The web is perforated so that each line of perforations includes groups of perforations having relatively low tensile strength which are separated by groups of perforations having relatively high tensile strength. The groups of relatively low tensile strength perforations on each line are transversely offset or staggered relative to the groups of relatively low tensile strength perforations on the adjacent lines.

Both of these perforation patterns allow weaker webs to be wound with higher speeds on center or surface rewinders, allow running of webs below minimum perforation tensile without experiencing web blowouts, allow a higher speed when running slip perf, allow increased product density or firmness by increasing tension on the web, and allow for reduction of sensitivity to rewinder dynamics such as mandrel vibrations and the like.

DESCRIPTION OF THE DRAWING

The invention will be explained in conjunction with illustrative embodiments shown in the accompanying drawing, in which.

DESCRIPTION OF SPECIFIC EMBODIMENTS

A. Description of Prior Art Perforation Patterns

Figure 1:
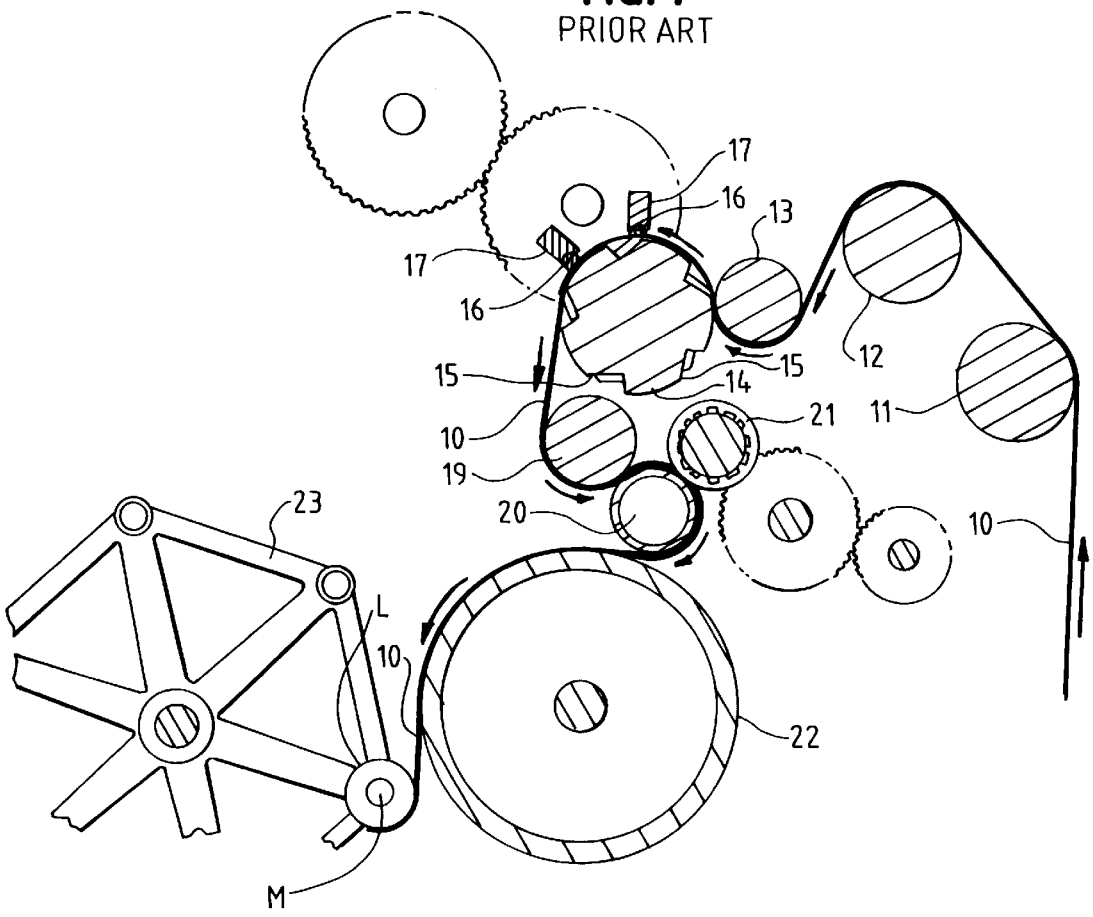
FIG. 1 PRIOR ART
FIG. 1 illustrates a prior art perforator and surface rewinder.
Figure 2:
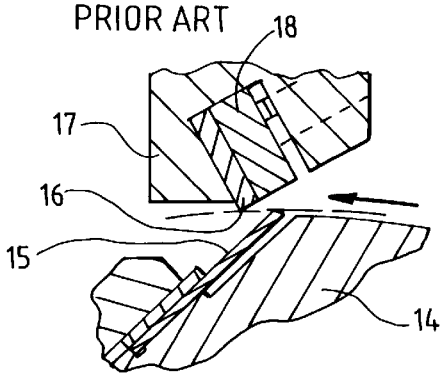
FIG. 2 PRIOR ART
FIG. 2 is an enlarged fragmentary sectional view of the perforator roll and the anvil of FIG. 1.

FIG. 1 illustrates a prior art perforator of the type which is described in U.S. Pat. No. 2,870,840. The numeral 10 designates a web of paper which is unwound from a large parent roll (not shown) and passes over rolls 11, 12, and 13 to a perforating roll 14. Referring to FIG. 2, perforating blades 15 are mounted on the rotating perforator roll and engage anvil blades 16 which are mounted on anvil 17 by anvil blade holders 18.

Figure 3:
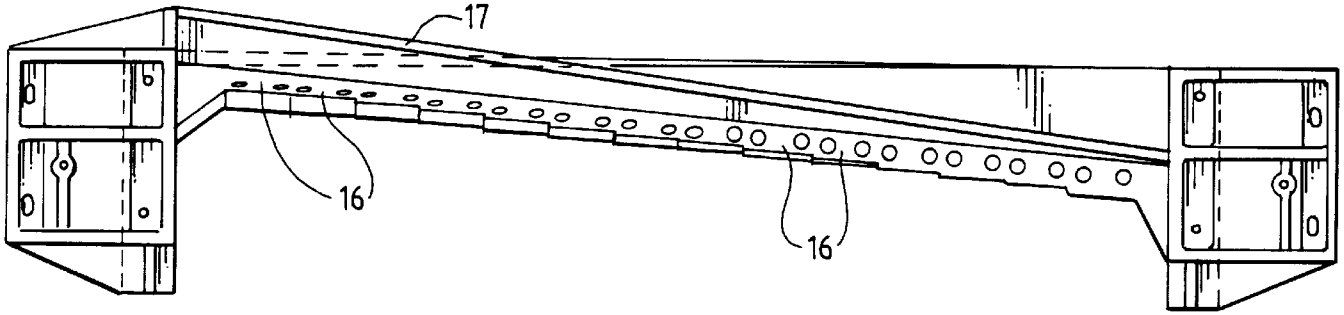
FIG. 3 PRIOR ART
FIG. 3 is a top plan view of the anvil of FIG. 1.
Figure 4:
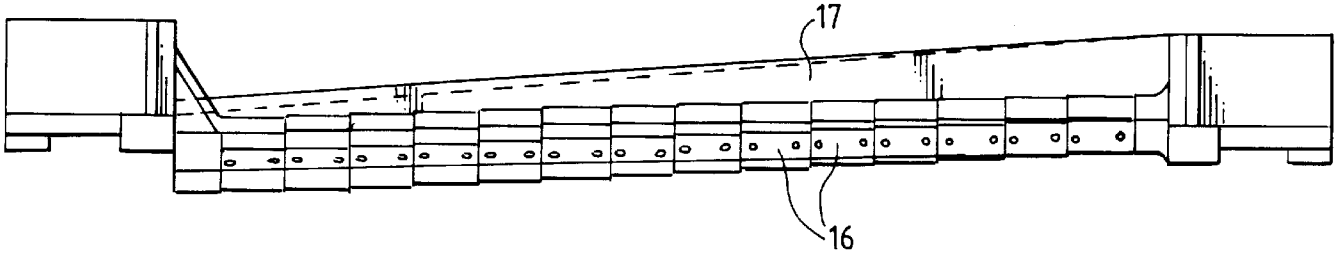
FIG. 4 PRIOR ART
FIG. 4 is a side elevational view of the anvil of FIG. 3.

Referring to FIGS. 3 and 4, the anvil blades 16 are mounted in a spiral arrangement on the anvil 17 so that the perforator blades 15 cooperate with the spirally-arranged anvil blades 16 to form perforations across the entire width of the web as the web moves across the successive anvil blades.

Figure 5:
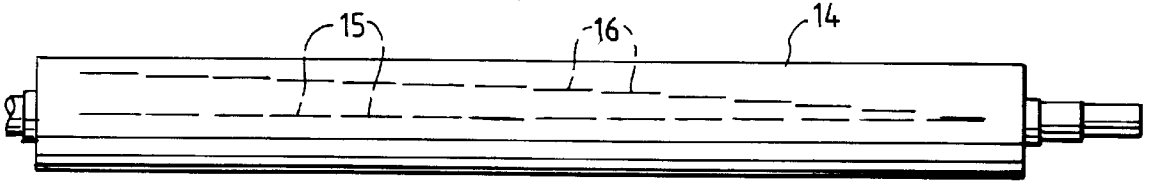
FIG. 5 PRIOR ART
FIG. 5 illustrates the perforator roll of FIG. 1.

As can be seen in FIG. 5, the perforator blades 15 are aligned with, and are spaced axially along, the longitudinal axis of the perforator roll 14. The perforator blades 15 are thus successively brought into engagement with the spirally mounted anvil blades 16 which are represented diagrammatically in FIG. 5. The web is first perforated on the right hand side of the perforator roll 14 in FIG. 5, and, as the web and the perforator roll continue to rotate with respect to the anvil, the remaining portion of the web is successively perforated from the right hand side of FIG. 5 to the left hand side as each of the perforator blades 15 is brought into contact with an anvil blade 16.

Referring again to FIG. 1, a plurality of longitudinal rows of perforator blades 15 are mounted in the perforator roll, and the circumferential distance between adjacent rows of perforator blades defines the perforation length or sheet length, i.e., the distance between successive transverse lines of perforations. In the United States the sheet length of bathroom tissue is conventionally 4.5 inches, and the sheet length of paper towels is conventionally 9 inches.

Still referring to FIG. 1, the perforated web is advanced from the perforator roll 14 over a roll 19 and a slitting roll 20 which cooperates with a slitter 21 to sever the web at the end of each log which is being wound on the rewinder. The web travels over a bedroll 22 to a rotating mandrel M which is mounted on a turret 23. As is well known in the art, a cardboard core is mounted on the mandrel M, and the web is wound on the rotating core to form a log L. The core rotates about an axis which extends parallel to the transverse dimension of the web.

Figure 6:
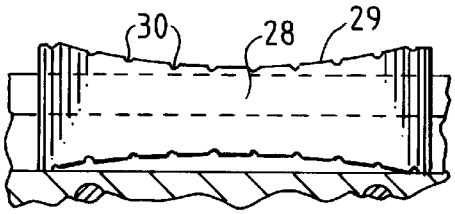
FIG. 6 PRIOR ART
FIG. 6 illustrates a prior art perforator blade.

FIG. 6 illustrates a typical prior art perforator blade 28. The length of the blade advantageously corresponds to the length of the individual rolls which are cut by the log saw, which is conventionally 4½ inches for bathroom tissue and 11 inches for paper towels. The blade includes a cutting edge 29 which is interrupted by a plurality of notches 30. The portions of the web which pass over the notches 30 are not cut and form bonds between the perforations.

Improvements in perforators are described in U.S. Pat. Re. 26,418 and U.S. Pat. No. 3,264,921, and an improved bedroll cut-off mechanism is described in U.S. Pat. Re. 28,353.

Figure 8:
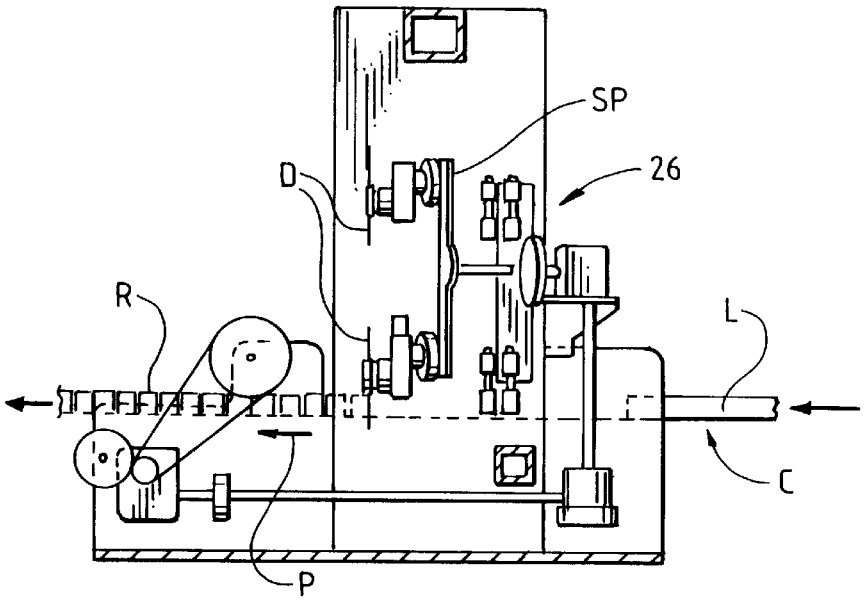
FIG. 8 PRIOR ART
FIG. 8 illustrates a prior art log saw.

Referring to FIG. 8, the wound log L is advanced from the rewinder on a conveyor C to a log saw 26. As described in U.S. Pat. No. 5,557,997 and Re. 30,598, the log is cut into a plurality of retail sized rolls R of bathroom tissue or paper towels by one or more cutting blades D which are orbited through the path P of the log by a rotating skew plate SP.

Figure 7:
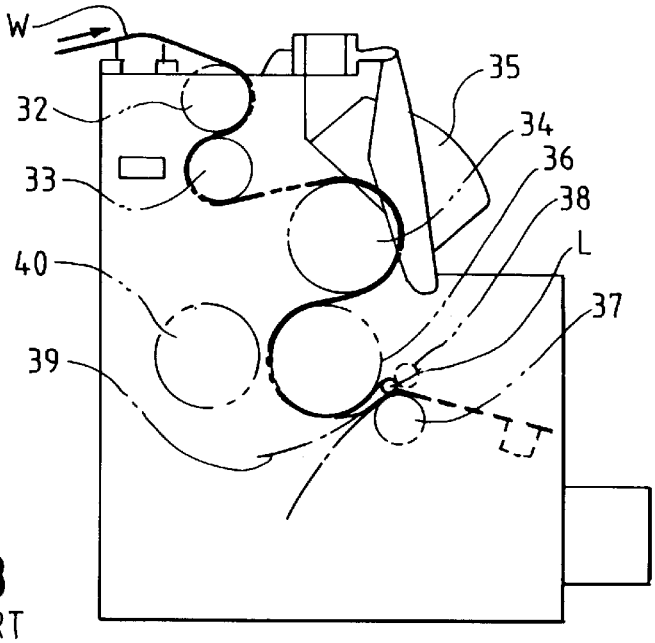
FIG. 7 PRIOR ART
FIG. 7 illustrates a prior art surface rewinder.

FIG. 7 illustrates a prior art surface rewinder 31 which can be used to perforate a web W and wind the web into a log L. Surface rewinders are described, for example, in U.S.

U.S. Pat. Nos. 5,839,688, 5,370,331, and 4,723,724.

The web W proceeds through draw rolls 32 and 33 and over a perforator roll 34 which is equipped with longitudinal rows of perforator blades. The perforator blades cooperate with an anvil 35 to perforate the web along transverse lines of perforations.

The perforated web is advanced from the perforator to a bedroll 36 and is wound into a log L in a conventional three roll cradle which is formed by the bedroll or first winding roll 36, a second winding roll 37, and a rider roll 38. Cardboard cores on which the web can be wound are inserted into the space between the first and second winding rolls by a core inserter apparatus 39. A chopper roll 40 cooperates with the bedroll to sever the web along a desired line of perforation which will provide the wound log with the desired number of sheets.

Figure 9:
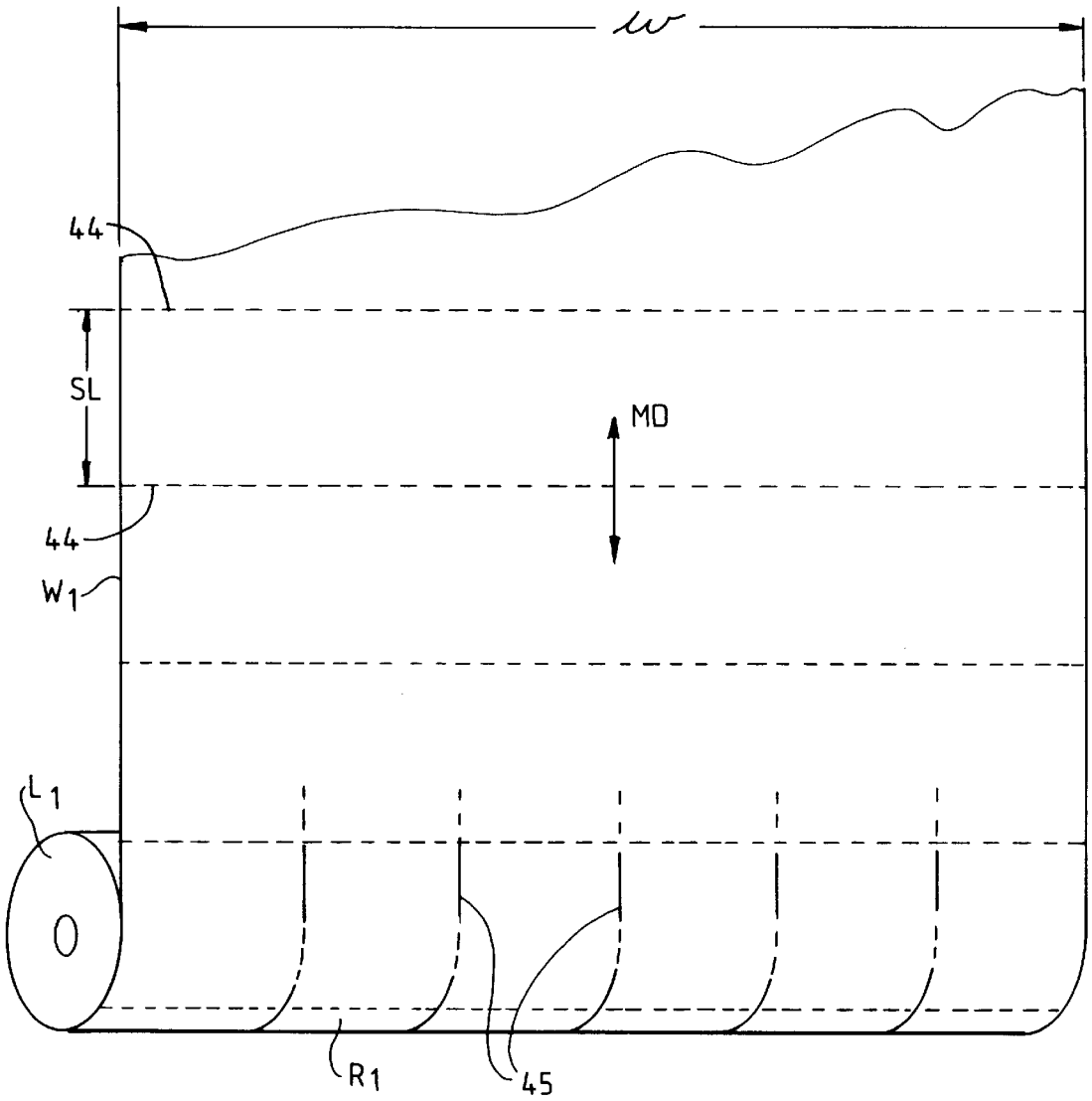
FIG. 9 PRIOR ART
FIG. 9 illustrates a conventional prior art perforation pattern.

FIG. 9 illustrates the perforation pattern of a conventional prior art log $L_1$ of bathroom tissue which is formed by winding a web $W_1$. The web has a longitudinal or machine direction MD and a transverse dimension or width w. The web is perforated along equally spaced transverse lines of perforation 44 which define the sheet length SL of the rolls of bathroom tissue which will be formed after the log is cut by the log saw. The longitudinal phantom lines 45 indicate where the log will be cut by the log saw after the web is wound in order to form individual rolls R of bathroom tissue. Since the perforations 44 are uniform along the width of the web, the cut lines 45 do not have to be positioned precisely.

B. Description of the Invention

Figure 10:
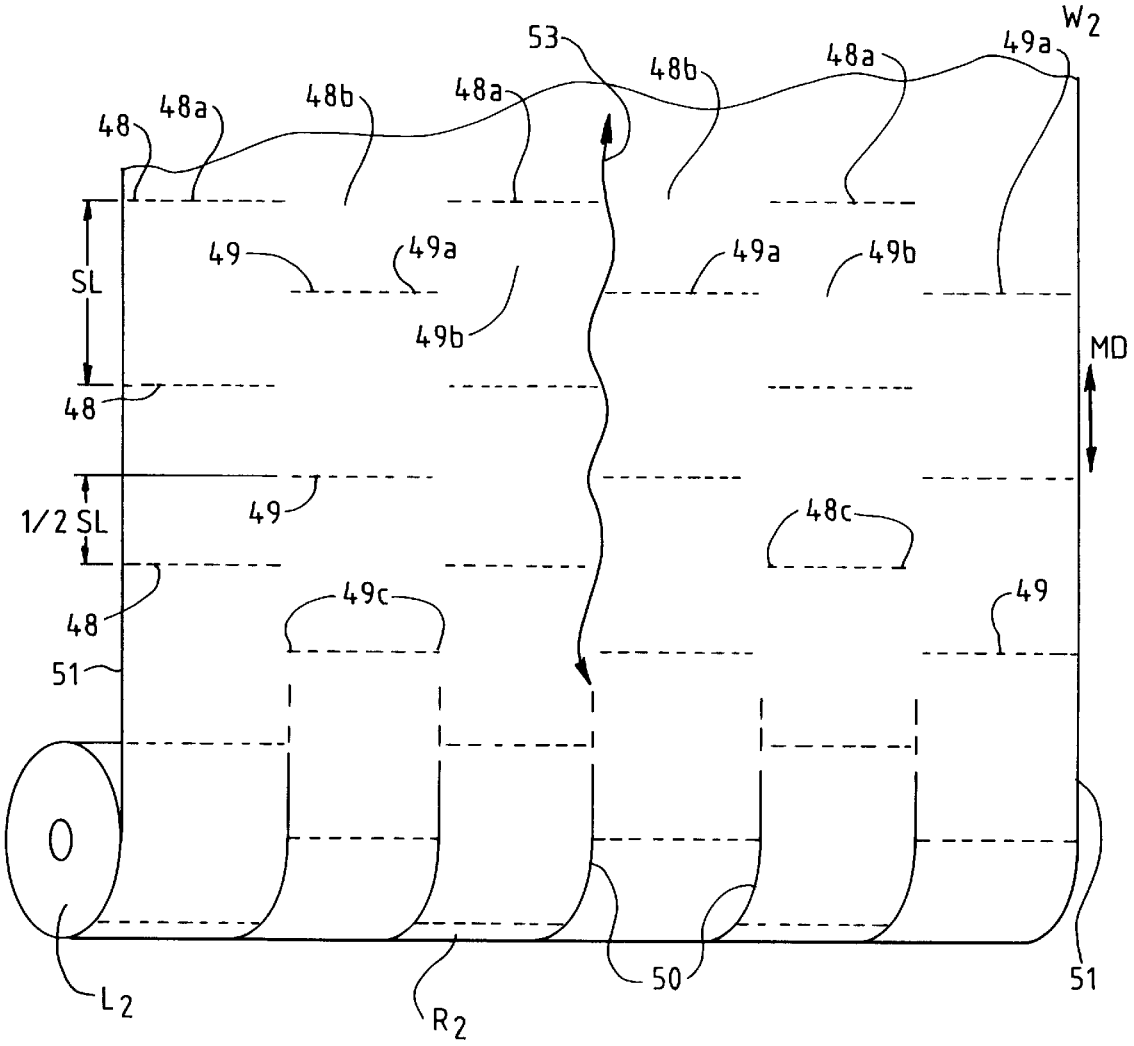
FIG. 10 illustrates the perforation pattern of one of the embodiments of the invention.

FIG. 10 illustrates one of the perforation patterns which is formed in accordance with the invention. A web $W_2$ which is wound into a log $L_2$ is provided with two sets of transversely extending perforation lines 48 and 49. Each of the perforation lines 48 of the first set includes groups of perforations 48*a* which are separated by unperforated areas 48*b*. Similarly, each of the perforation lines 49 of the second set includes groups of perforations 49*a* which are separated by unperforated areas 49*b*.

The perforation lines 48 and 49 alternate in the longitudinal direction or machine direction MD of the web, and the perforations 48*a* are staggered or transversely offset from the perforations 49*a*.

Each group of perforations 48*a* has a pair of ends 48*c*, and each group of perforations 49*a* has a pair of ends 49*c*. The ends 48*c* and 49*c* are aligned, or substantially aligned, along longitudinal lines which are indicated in phantom at 50. If the log $L_2$ is cut on transverse planes which correspond to the lines 50, each roll $R_2$ which is formed by the cuts will include perforations from only one of the groups 48*a* or 49*a*. The term "substantially aligned" is meant to include normal manufacturing tolerances and quality control tolerances which accept the appearance of a roll which is formed by cutting through an end portion of one or both of the groups of perforations 48*a* and 49*a*.

The perforation lines 48 are separated in the longitudinal direction by a dimension SL which corresponds to the sheet length of the resulting roll. Similarly, the perforation lines 49 are also separated by the dimension SL. Each of the perforation lines 48 is separated in the longitudinal direction from the adjacent perforation lines 49 by a dimension ½ SL.

Although the web $W_2$ is illustrated in FIG. 10 as having side edges 51 which correspond to an edge of one of the rolls $R_2$ it will be understood that wound logs conventionally include trim at each end of the log which is cut from the log by the log saw as described, for example, in U.S. Pat. No. 5,458,033. Also, for ease of illustration, the log $L_2$ as shown in FIG. 10 forms only six rolls $R_2$, whereas commercial logs can have a length of 100 inches or more.

The staggered perforation pattern of FIG. 10 provides a plurality of continuous bands 53 of non-perforated web which extend in the machine direction of the web in a slightly zig-zag configuration around the ends of the perforations 48*a* and 49*a*. The bands of non-perforated web support increased tension in the web and allow weaker webs to be run at higher speeds on both center and surface rewinders, allow running of webs below the perforation tensile strength, i.e., the tension at which the perforations will tear, without experiencing web blowouts, allow increasing tension on the web during winding in order to increase the density and firmness of the wound log, and reduce the sensitivity of the web to rewinder dynamics such as mandrel vibrations and the like.

Figure 11:
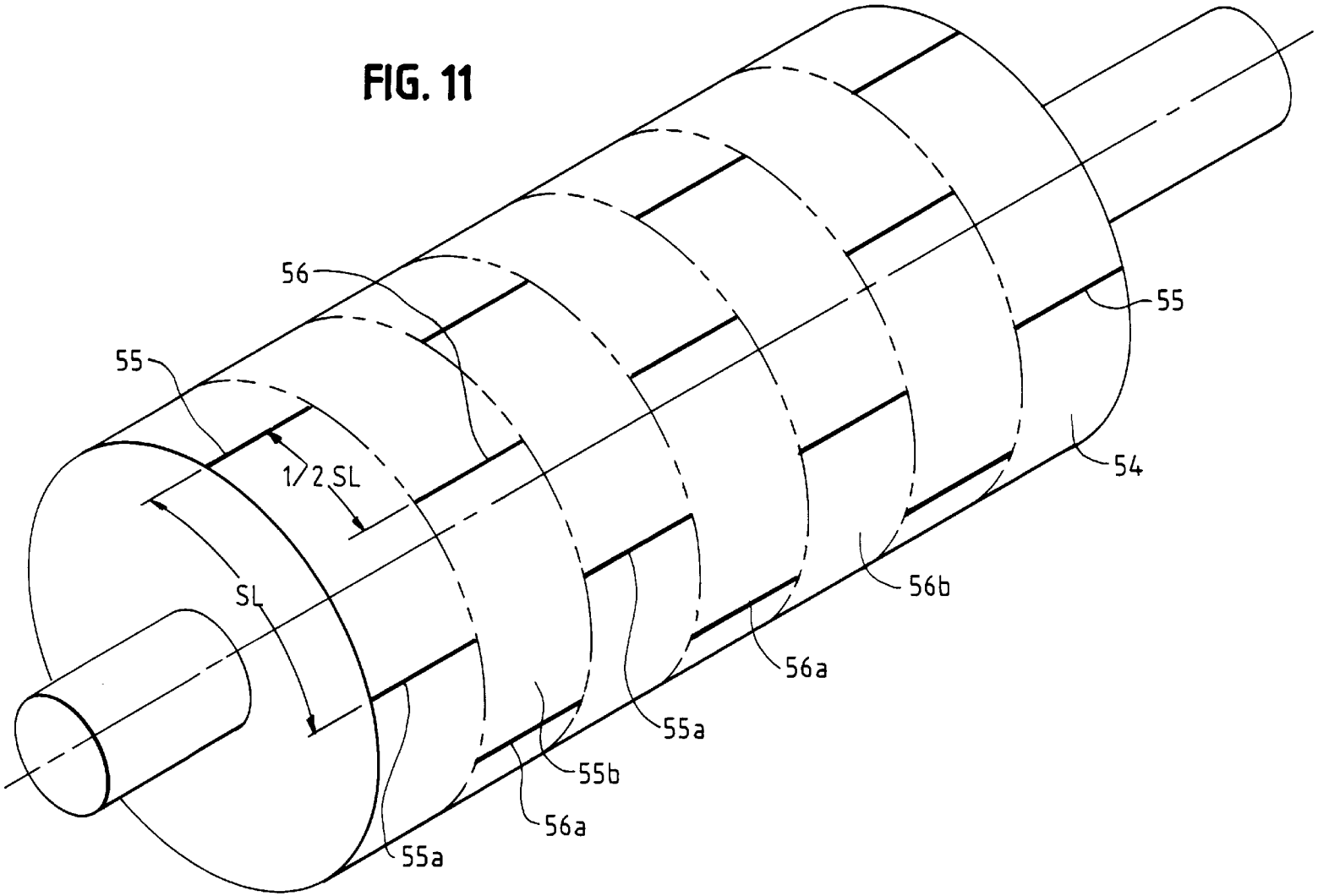
FIG. 11 illustrates a perforator roll which is used to provide the perforation pattern of FIG. 10.

FIG. 11 illustrates a perforator roll 54 which can be used to form the perforation pattern of FIG. 10. The perforator roll 54 includes a plurality of circumferentially spaced sets of perforator blades 55 which provide the perforation lines 48, and a plurality of circumferentially spaced sets of perforator blades 56 which provide the perforation lines 49. Each set 55 includes transversely spaced perforator blades 55*a* which are separated by gaps 55*b*. Similarly, each set 56 includes transversely spaced blades 56*a* which are separated by gaps 56*b*. The blades 55*a* and 56*a* form the perforations 48*a* and 49*a*, respectively, and the gaps 55*b* and 56*b* correspond to the non-perforated web areas 48*b* and 49*b*.

The circumferential spacing between the sets 55 of blades and between the sets 56 of blades corresponds to the sheet length SL, and the circumferential spacing between adjacent sets 55 and 56 of blades correspond to ½ SL.

Figure 12:
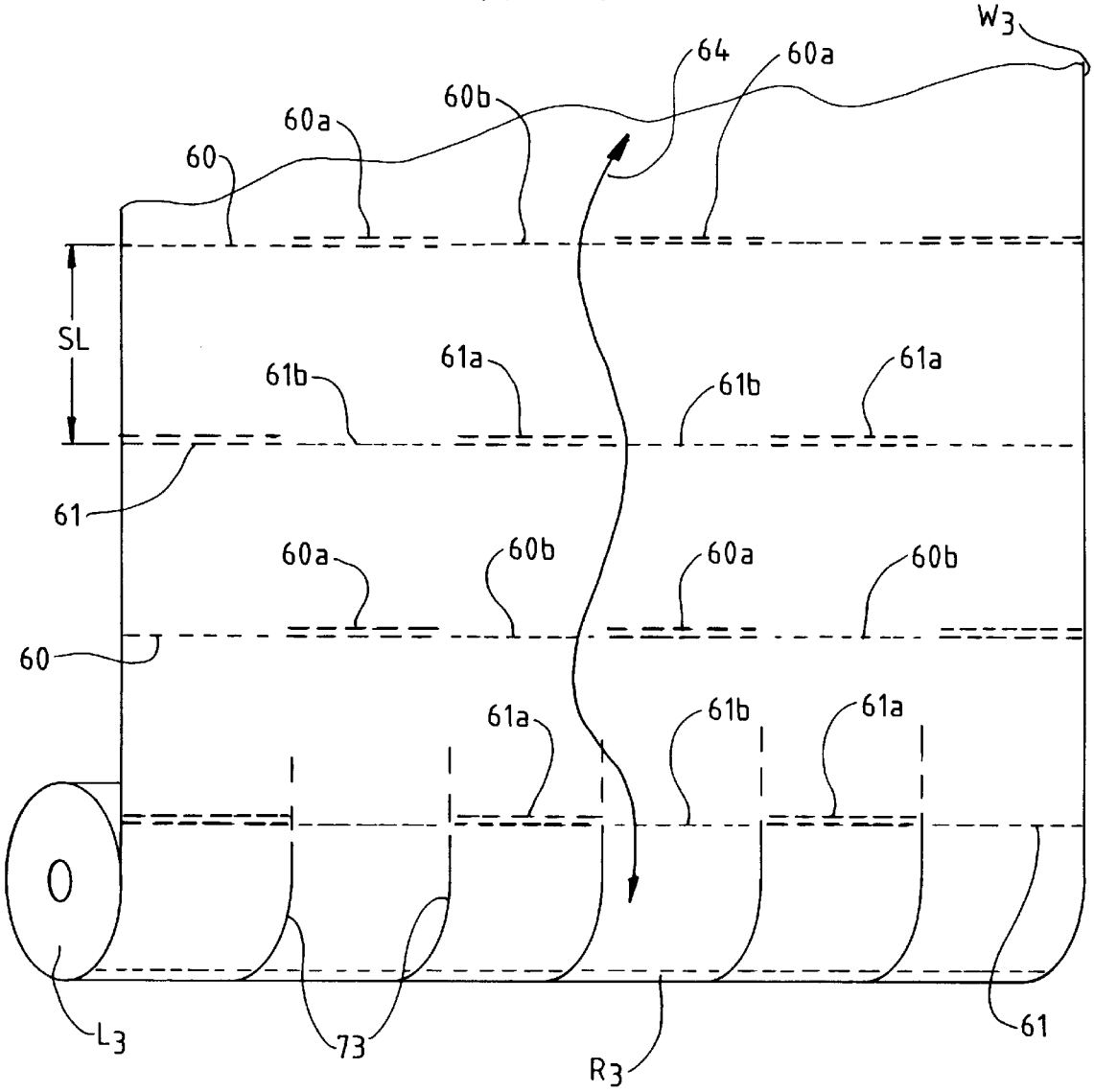
FIG. 12 illustrates the perforation pattern of another embodiment of the invention.

The staggered perforation pattern of FIG. 10 requires precise positioning of the cuts which are made by the log saw so that the log is cut on the transverse planes which correspond to the longitudinal lines 50 of the web. FIG. 12 illustrates a staggered perforation pattern which requires a less precise positioning of the log saw cuts.

A web $W_3$ is provided with two sets of longitudinally spaced transverse perforation lines 60 and 61. Each perforation line 60 includes groups of perforations 60*a* having relatively low tensile strength which are transversely separated by groups 60*b* of perforations having relatively high tensile strength. Similarly, each perforation line 61 includes groups of perforations 61*a* of relatively low tensile strength which are transversely separated by groups of perforations 61*b* of relatively high tensile strength.

For purposes of illustration, the perforations 60*a* and 61*a* having relatively low tensile strength are diagrammatically illustrated in FIG. 12 by double dashed lines, and the perforations 60*b* and 61*b* having relatively high tensile strength are illustrated diagrammatically by single dashed lines.

The low tensile perforations of each of the transverse lines of perforation are staggered or transversely offset from the low tensile perforations of the adjacent lines of perforation. Similarly, the high tensile perforations of each line of perforation are staggered or transversely offset from the high tensile perforations of adjacent lines of perforation. Accordingly, the web is provided with a plurality of longitudinally extending bands 64 of relatively high strength which zig-zag through the portions 60*b* and 61*b* of the transverse lines of perforation which have the high tensile strength perforations. The tensile strength of the web is thereby increased in a manner which is similar to the manner in which the tensile strength of web $W_2$ is increased.

Figure 13:
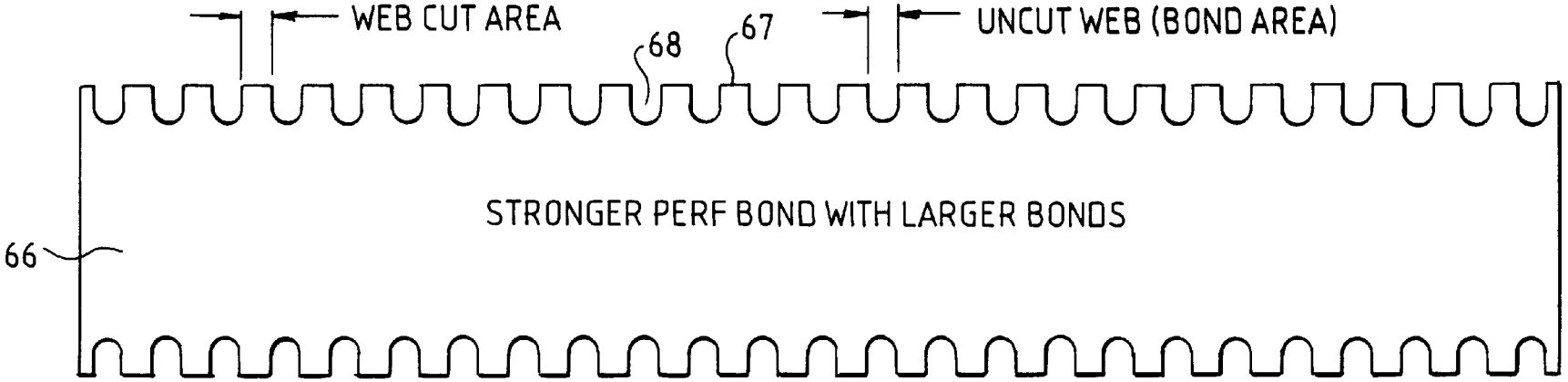
FIG. 13 illustrates one of the perforator blades which are used to form the perforations of FIG. 12 which have relatively high tensile strength.
Figure 14:
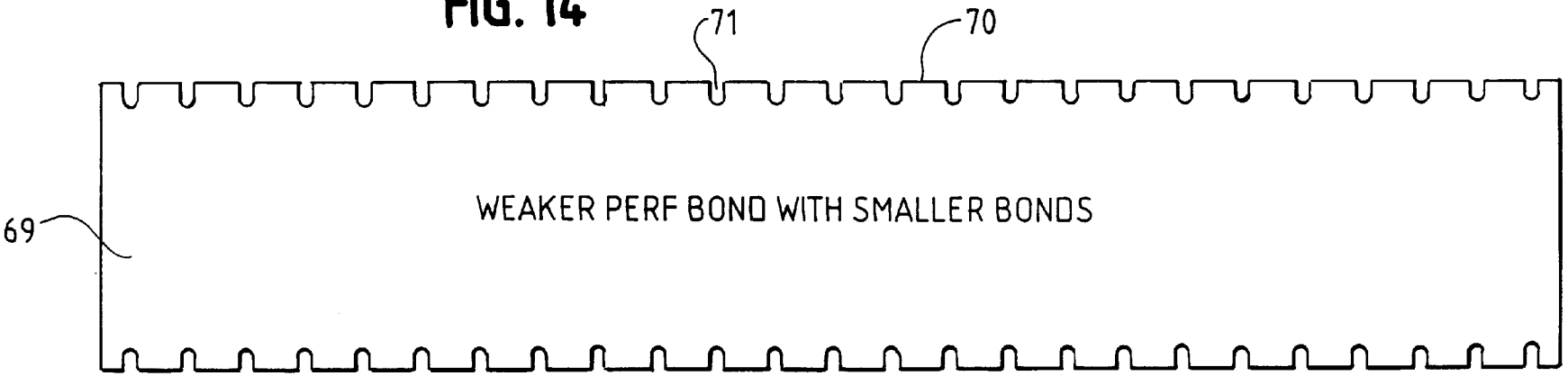
FIG. 14 illustrates one of the perforator blades which are used to form the perforations of FIG. 12 which have relatively low tensile strength.

FIGS. 13 and 14 illustrate one way of obtaining perforations with different tensile strength. FIG. 13 illustrates a perforator blade 66 which includes cutting edges 67 which are interrupted by notches 68. The cutting edges cut the web, and the notches form uncut or bonded areas in the web. Longer bonds increase the tensile strength of the perforations.

FIG. 14 illustrates a perforator blade 69 which forms perforations having lower tensile strength than the perforations which are formed by the blade 66. Longer cutting edges 70 are separated by narrow notches 71 which provide relatively short bonded or unperforated areas in the web.

Each of the perforation lines 60 and 61 are formed by alternating the perforator blades 66 and 69 on each of the longitudinal rows of perforator blades in the perforator roll. The length of each of the perforator blades advantageously corresponds to the length of the individual rolls which will be formed after the log is cut.

The tensile strength of the perforations can be varied by changing the width of the bonded areas between perforations and/or the number of bonds per unit length along the perforation line. The tensile strength of a group of perforations is increased by increasing the total bonded length per unit length along the perforations. The perforations which have relatively low tensile strength will tear more easily than the perforations which have relatively high tensile strength. However, the tensile strength of even the high tensile perforations is such that the perforations can be torn evenly and without difficulty when it is desired to separate a sheet from a roll.

The terms "relatively low tensile strength" and "relatively high tensile strength" are relative terms. Persons skilled in the art can select the tensile strengths they desire by balancing the objective of providing perforations which tear easily and cleanly with the objective of increased web tensile strength.

Each of the groups of low tensile perforations 60*a* and 61*a* have a pair of ends which may be substantially aligned with longitudinal lines on the web which are indicated in phantom at 73. Similarly, each of the groups of high tensile perforations 60*b* and 61*b* have a pair of ends which may also be substantially aligned with the longitudinal lines 73. If the log $L_3$ is cut on transverse planes which correspond to the lines 73, each roll $R_3$ will include alternating lines of perforations having low tensile strength and high tensile strength. However, since the sheets of the rolls can be torn on either low tensile perforations or high tensile perforations, precise positioning of the ends of the low tensile and high tensile perforations and/or precise positioning of the cuts in the log may not be necessary for the perforation pattern of FIG. 12.

It is also not necessary to stagger the groups of relatively low strength and relatively high strength perforations. The groups of relatively high strength perforations of all of the lines of perforations could be longitudinally aligned, and the web would have transversely spaced longitudinal bands of relatively high tensile strength which extend through the groups of high strength perforations. However, we believe that staggering the groups of high and low strength perforations in adjacent lines of perforations provides a stronger web because longitudinal bands which pass through low strength perforations will also pass through high strength perforations.

Another advantage of the perforation pattern of FIG. 12 is that the pattern can be formed by existing perforator rolls and does not require manufacturing a new perforator roll in order to mount adjacent rows of perforator blades at one-half of the sheet length.

The perforation pattern of FIG. 12 uses perforations of both low and high tensile strength. However, the perforation pattern of FIG. 10 enables a perforated web to have relatively high tensile strength even if relatively low tensile perforations are used. Some manufacturers prefer to use low tensile perforations.

The FIG. 10 embodiment could also include groups of perforations of different tensile strength. For example, the perforations 48*a* could have relatively low tensile strength and the perforations 49*a* could have relatively high tensile strength. Alternatively, the groups of perforation in each of the perforation lines 48 and 49 could alternate between relatively low strength and relatively high strength perforations.

While in the foregoing specification a detailed description of specific embodiments of the invention were set forth for the purpose of illustration, it will be understood that many of the details herein given may be varied considerably by those skilled in the art without departing from the spirit and scope of the invention.

We claim:

1. A method of perforating a web of paper comprising the steps of:

advancing an elongated web of paper having a longitudinal dimension and a transverse dimension in a direction which extends parallel to the longitudinal dimension, and perforating the web along a plurality of transversely extending lines which extend transversely across the web so that each of said lines includes a plurality of groups of perforations which are interrupted by unperforated areas, the groups of perforations on each of said transverse lines being transversely offset from the groups of perforations on adjacent transverse lines, each said group of perforations being substantially aligned in the longitudinal direction with and having substantially the same transverse length as each said unperforated areas of adjacent transverse lines.

2. The method of claim 1 in which each of said groups of perforations includes a pair of ends, the ends of the groups being substantially aligned along lines which extend parallel to the longitudinal dimension of the web.

3. The method of claim 2 including the step of winding the web into a log by winding the web about an axis which extends parallel to the transverse dimension of the web and severing the log at transversely spaced locations where the ends of said groups of perforations are substantially aligned.

* * * * *